US006834522B2

(12) United States Patent
Leppin et al.

(10) Patent No.: US 6,834,522 B2
(45) Date of Patent: Dec. 28, 2004

(54) HIGH INTERNAL PRESSURE FORMING PROCESS

(75) Inventors: Christian Leppin, Schaffhausen (CH); Markus Gehrig, Schaffhausen (CH)

(73) Assignee: Alcan Technology & Management Ltd. (CH)

( * ) Notice: Subject to any disclaimer, the term of this patent is extended or adjusted under 35 U.S.C. 154(b) by 23 days.

(21) Appl. No.: 10/347,016

(22) Filed: Jan. 17, 2003

(65) Prior Publication Data

US 2003/0133810 A1 Jul. 17, 2003

(30) Foreign Application Priority Data

Jan. 17, 2002 (EP) ..... 02405027

(51) Int. Cl.[7] ..... B21D 39/08; B21D 39/20
(52) U.S. Cl. ..... 72/58; 72/61; 72/62; 417/401
(58) Field of Search ..... 417/254, 401, 417/404; 72/58, 60, 61, 62

(56) References Cited

U.S. PATENT DOCUMENTS 4,364,251 A 12/1982 Nishihara et al.
4,619,129 A * 10/1986 Petkov et al. ..... 72/56
4,840,053 A * 6/1989 Nakamura ..... 72/58
5,765,420 A * 6/1998 Schaefer ..... 72/55
6,014,879 A * 1/2000 Jaekel et al. ..... 72/61
6,029,487 A * 2/2000 Genin et al. ..... 72/58
6,067,830 A * 5/2000 Klages et al. ..... 72/55
6,128,936 A * 10/2000 Yogo ..... 72/58
6,282,934 B1 * 9/2001 Bikert et al. ..... 72/58
6,439,018 B1 * 8/2002 Hellgren et al. ..... 72/58

FOREIGN PATENT DOCUMENTS

DE 19530056 2/1997 ..... B21D/26/02
DE 19751035 5/1999 ..... B21D/26/02
DE 19805172 8/1999 ..... B21D/39/08
WO WO0128708 4/2001 ..... B21D/26/02

* cited by examiner

*Primary Examiner*—Charles G. Freay
(74) *Attorney, Agent, or Firm*—Ostrolenk, Faber, Gerb & Soffen, LLP

(57) ABSTRACT

A device for forming a single or mutli-chamber workpiece by high internal pressure created by a medium capable of flow in the hollow interior of the workpiece. The device contains a forming tool with a cavity accommodating the workpiece and pressure generating equipment for generating the high internal pressure. The pressure generating equipment contains a displacement pump with a pressure converter having a longitudinally coupled displacement body with different working surface areas $A_1$, $A_2$, which operates with a stroke frequency f, whereby strokes of the pressure converter cause a pressure $p_1$ created on the primary side to be raised until a higher secondary pressure $p_2$ is reached on the secondary side.

23 Claims, 3 Drawing Sheets

HIGH INTERNAL PRESSURE FORMING PROCESS

BACKGROUND OF THE INVENTION

The present invention relates to a device for forming a workpiece exhibiting at least one hollow space in its interior by means of high internal pressure created by a medium capable of flow in the sealed hollow interior of the workpiece, said device containing a forming tool with a cavity accommodating the workpiece and pressure generating equipment for generating high internal pressure. The invention also relates to a process for forming the said workpiece using a device according to the invention.

In so called high internal pressure forming processes, in the following referred to as HIPF processes, a hollow body is stretched or formed by means of high internal pressure. For that purpose the openings in the hollow body are sealed by sealing stems in order to build up and maintain a positive pressure in the said space by means of a working or pressure medium which is introduced past the sealing stem into the hollow interior of the workpiece. The positive pressure leads to the workpiece being stretched or formed, whereby the hollow body takes on the shape of the tool cavity in which the hollow body was laid.

For some time now the HIPF process has been employed in combination with shaping and cutting, stamping or perforating. That means that during the HIPF process openings have been made or created in the walls by means of the high internal pressure.

The pressures that have to be built up depend, amongst other things, on the material to be formed, the shape and the wall thickness of the workpiece and on the geometry and degree of deformation. Further, pressing out openings by means of the HIPF process makes special requirements on the internal pressure.

Up to now, in order to create the high internal pressure, so called uniformly working pressure converters with hydraulic drive for liquid media have been employed. Uniformly working pressure converters are in their function two longitudinally coupled cylinders with working surfaces $A_1$, $A_2$ of different sizes, practically designed as equipment with differential pistons by means of which the pressure $p_1$ built up on the primary side is transformed to a higher final pressure—the so called secondary pressure $p_2$, whereby the differential pistons traverse a single distance in order to generate the pressure. The pressure increase factor is obtained—neglecting frictional losses—by the ratio of the working surface areas:

$$p_2/p_1=A_1/A_2$$

As the pressure converter on the secondary side operates with a relatively large piston area, the primary side drive is normally made using liquid media.

Normally, the pressure generating equipment contains a pre-fill pump which feeds the high internal pressure system with pressure medium at the start of the forming process and at the same time creates an elevated base pressure. Subsequently, the final or forming pressure is created using pressure converters. As the volume flow of the almost incompressible liquid medium is small because of the previously generated base pressure, the forming pressure created by the differential piston is reached right away, whereby the single distance traversed by the differential piston is as a rule less than the maximum possible single piston displacement.

The maximum volume flow of pressure medium that can be created is limited by the single piston displacement i.e. after the differential piston has accomplished the single piston displacement, it is not possible to achieve a further increase in pressure. This problem arises e.g. in cases in which the pressure converter has to generate relatively high volume flow, such as for example when there is a leak on the high pressure side or for very large stretching of the section in the forming process. It can happen, therefore, that the pressure converter is not able to generate the necessary maximum pressure as this has not yet been reached after a single stroke of the piston.

Conventional HIPF devices fitted with pressure converters are relatively inflexible as the volume flow that a pressure converter is able to generate to reach the high internal pressure is limited by the single piston stroke. Further, the installation and operation of conventional pressure converters is relatively complicated, therefore e.g. temporary installation of an HIPF device for trials or for small series production is hardly economical using pressure converters that operate in the conventional manner.

SUMMARY OF THE INVENTION

The object of the present invention is to propose an HIPF device with a pressure generating device which permits flexible adaptation with respect to the maximum pressures, and is flexible from the standpoint of installation and operation while at the same time being cost favourable.

That objective is achieved by way of the invention in that the pressure generating equipment contains a displacement pump, preferably a reciprocating pump, with pressure converter (pressure intensifier) from a longitudinally coupled displacement body with different working surface areas $A_1$, $A_2$, and the displacement body operates with a stroke frequency f, and a pressure $p_1$ created on the primary side can be converted in a higher secondary pressure $p_2$ by means of strokes of the pressure converter until an end pressure is reached on the secondary side, whereby the relationship:

$$p_2/p_1=A_1/A_2$$

defines the increase in pressure.

Further, the invention also relates to a device for forming a workpiece exhibiting at least one hollow space in its interior by means of a high internal pressure created by a medium capable of flow in the sealed hollow interior of the workpiece, said device containing a forming tool with a cavity accommodating the workpiece, whereby the forming tool contains means for producing recesses, in particular holes in the workpiece during the high internal pressure forming process, and the means comprise a stem fitting in space in the wall of the forming tool, whereby the recesses are created by withdrawing the stem from the workpiece, and the stem movement is controlled by the counterpressure on the stem and the stem counterpressure is generated via pressure generating equipment. The said pressure generating equipment contains a displacement pump with pressure converter comprising a longitudinally coupled displacement body with different working surface areas $A_1$, $A_2$, and the displacement body operates with a stroke frequency f, and by means of strokes of the pressure converter a pressure $p_1$ created on the primary side can be converted until a higher secondary pressure $p_2$ is reached on the secondary side, whereby the relationship:

$$p_2/p_1=A_1/A_2$$

defines the increase in pressure.

The pressure converter of the displacement pump working with a stroke frequency f during the forming process in order to reach a final pressure on the secondary side is, consequently, in contrast to uniform working pressure converters, an oscillating pressure converter which traverses the given piston distance more than once. Therefore, in contrast to uniform working pressure converters, an unlimited volume flow of pressure-building medium can be produced continuously, as this is not dependent on a single stroke of the piston.

The workpieces may be e.g. single or multi-chamber hollow sections with openings at the ends. Further, the workpieces may also be hollow bodies having the shape of a container. The workpieces are preferably of metal, in particular aluminium or an aluminium alloy.

The pressure generating equipment for generating the high internal pressure and/or the counterpressure on the stem preferably contains a multi-stroke high pressure piston pump also known as high pressure piston pump. On the primary side the high pressure piston pump is preferably operated pneumatically i.e. with a gas such as compressed air in the range 1–15 bar, whereby the compressed air is brought to a higher pressure by means of a separate facility such as a compressor and fed to the displacement pump. The high pressure piston pump may also be operated by hydraulic means on the primary side i.e. with a liquid medium. The suction action in the high pressure piston pump is preferably automatic i.e. self-acting.

The high pressure piston pump may be powered by single or multi-stage drive on the primary side. That means that the high pressure piston pump may exhibit one, two, three or more coupled pistons on the primary side. The high pressure piston pump with one, two, three or more coupled pistons on the primary side may also be a high pressure piston pump with single or double stroke, i.e. the high pressure piston pump generates pressure on the secondary side in one or both directions of stroke.

In a preferred version of the invention the pressure generating equipment contains a plurality of parallel high pressure piston pumps to generate the high internal pressure and/or the counterpressure on the stems. The high pressure piston pumps serve a common high pressure system, whereby the high pressure piston pumps are preferably controlled via a stroke frequency transformer (frequency converter) i.e. a pneumatic stroke frequency transformer, in order to achieve as constant as possible power flow, so that in alternating strokes continuous power flow is achieved until the desired pressure is reached.

The working medium which is employed on the secondary side e.g. to achieve the high internal pressure and/or stem counterpressure is preferably a thin to viscous medium. The said medium may contain e.g. water and/or oil and may be e.g. a water-oil emulsion. On the primary side the piston drive may take place—as already mentioned—by means of a liquid or a gas.

The pressure converter of the high pressure piston pump preferably contains a high pressure piston with small piston face area, which is a component of a high pressure chamber, and a drive piston, in particular an air driven piston with large piston face area which is a component of a drive chamber in particular an air driven chamber. The operating pressure depends essentially on the conversion ratio of the drive piston and the high pressure piston. As the differential piston is characterised by way of an oscillating mode of operation, and thereby the volume flow that can be generated is in principle unlimited, the piston area on the high pressure side can be very small in comparison with conventional pressure converters that work uniformly—which in turn reduces the size of the equipment.

If the drive chamber is air-powered, then this exhibits an air drive input port to which the air drive supply line is connected. By employing a compressed air regulator in the air drive supply line it is, if desired, possible and easy to pre-set the operating pressure. The high pressure chamber is provided with a suction side coupled to a suction port and a pressure chamber connected to a pressure port. The suction port is provided with an inlet armature and the pressure port with an outlet armature. The armatures may be e.g. valves such as inlet or outlet valves, flaps or slides which if desired are sensor controlled.

By means of a pre-stroke of the drive piston a negative pressure is created in the high pressure chamber, as a result of which the inlet valve is opened on the suction side of the pump and the working medium flows from the suction side into the piston chamber on the high pressure side while the outlet valve remains closed. By means of air power a reverse stroke is created on the primary side, as a result of which a secondary pressure is built up on the high pressure side, causing the outlet valve to open and, via a pressure supply line, a high internal pressure or stem counterpressure is created in the forming tool. The inlet valve remains closed during this step in the process.

The high pressure piston pump works until the desired final pressure or balance in pressure has been reached. If there is a drop in pressure e.g. due to leaking seals, the high pressure piston pump can again create the balance in pressure. By means of pressure sensors and a pressure regulating unit the operating mode of the high pressure piston pump can be automated, so that the high pressure piston pump stops automatically on reaching the final or intended pressure and, in cases where there is a drop in pressure, automatically restoring the intended pressure.

The pressure is maintained, without energy consumption, as long as no drop in pressure occurs on the high pressure side, as the closed outlet valve on the high pressure side prevents any drop in pressure. The pressures created for high internal pressure forming and/or integral forming of holes by high pressure controlled stems may be up to 4000 bar.

The high pressure piston pumps may contain so called wind kettles (i.e. compressed-air chamber) (suction and pressure wind kettles) in the suction and/or pressure lines in order to compensate for the pulsating volume flow.

The pressure generating equipment for generating the high internal pressure and/or the stem pressure contains preferably pre-fill pump for filling the workpiece with the working medium and for creating the base pressure on which the final pressure is built up by one or more high pressure piston pumps. A base pressure e.g. of 1 to 150 bar can be created using the pre-fill pump. Especially preferred are base pressures of 1 to 10 bar. The pre-fill pump may be e.g. a rotary pump.

In principle unlimited volume flow can be created using the displacement pump, therefore in some cases it is possible to dispense with a pre-fill pump.

The device according to the invention may contain, in accordance with the invention, pressure generating equipment both for generating a high internal pressure and for creating a counterpressure for the purpose of forming recesses, in particular openings, in the workpiece during the high internal pressure forming process by means of pressure controlled stems. The pressure to be generated for both steps in the process may be created using the same pressure generating equipment.

Preferably, however, pressure is generated by means of separate, non-coupled pressure generating equipment.

The forming tool may be closed and held closed via attachment means such as screws. Closing and holding the forming tool closed may take place via a hydraulic device.

Also included in the scope of the invention is that the closing and holding forces to be applied to the forming tool may be generated by means of a displacement pump, in particular by means of a high pressure piston pump such as described in the text above. All variants of the displacement or high pressure piston pumps described above apply here too.

Further, also within the scope of the invention with respect to creating the forces for closing and holding the forming tool closed and for moving the cylinder, also called stem sealing the hollow space inside the workpiece, at least one displacement pump is foreseen, in particular a high pressure piston pump as described in the above text. All variants of the displacement or high pressure piston pumps described above apply here too.

The use of displacement or high pressure piston pumps in the above described HIPF equipment for generating the high internal pressure, for generating the stem counterpressure for creating holes, for generating the forces for closing and holding the forming tool closed or for generating the closure and holding forces for the sealing stems may be foreseen for each application individually and independent of the other application purposes or together in any combination. Likewise, separate pressure generating equipment or such equipment coupled together may be used for each application.

The invention relates also to a process for forming a workpiece exhibiting at least one hollow space by means of high internal pressure created using a medium capable of flow in the sealed hollow space, whereby the high internal pressure is generated by means of a displacement pump.

The device according to the invention permits flexible adaptation of the HIPF equipment to the performance requirements of the forming process. As necessary, the pressure to be applied can be increased without problem simply by switching in further high pressure piston pumps. The said high pressure piston pumps are, in contrast to uniformly working pressure converters, lower in weight and smaller in size so that the device according to the invention can be assembled and dissembled rapidly and without problem, and can be transported.

Further, the invention permits separation of the forming tool and the pressure generating equipment, whereby the generated pressure is transmitted to the forming tool via pressure supply lines.

The use of high pressure piston pumps of the kind described above for the purpose of controlling the pressure and counterpressure on the stem has the additional advantage that no pressure converter has to be employed within the opening in the wall. As a result, the maximum diameter of opening in the wall need be the same or only slightly larger than the diameter of the stem. Consequently, a plurality of recesses situated close to each other may be created by individually controlled stems. Further, the expenditure required to produce stem openings in the tool mould is much smaller.

BRIEF DESCRIPTION OF THE DRAWINGS

In the following the invention is described in greater detail by way of example and with reference to the accompanying drawings which show in.

DETAILED DESCRIPTION OF THE PREFERRED EMBODIMENTS

Figure 1:
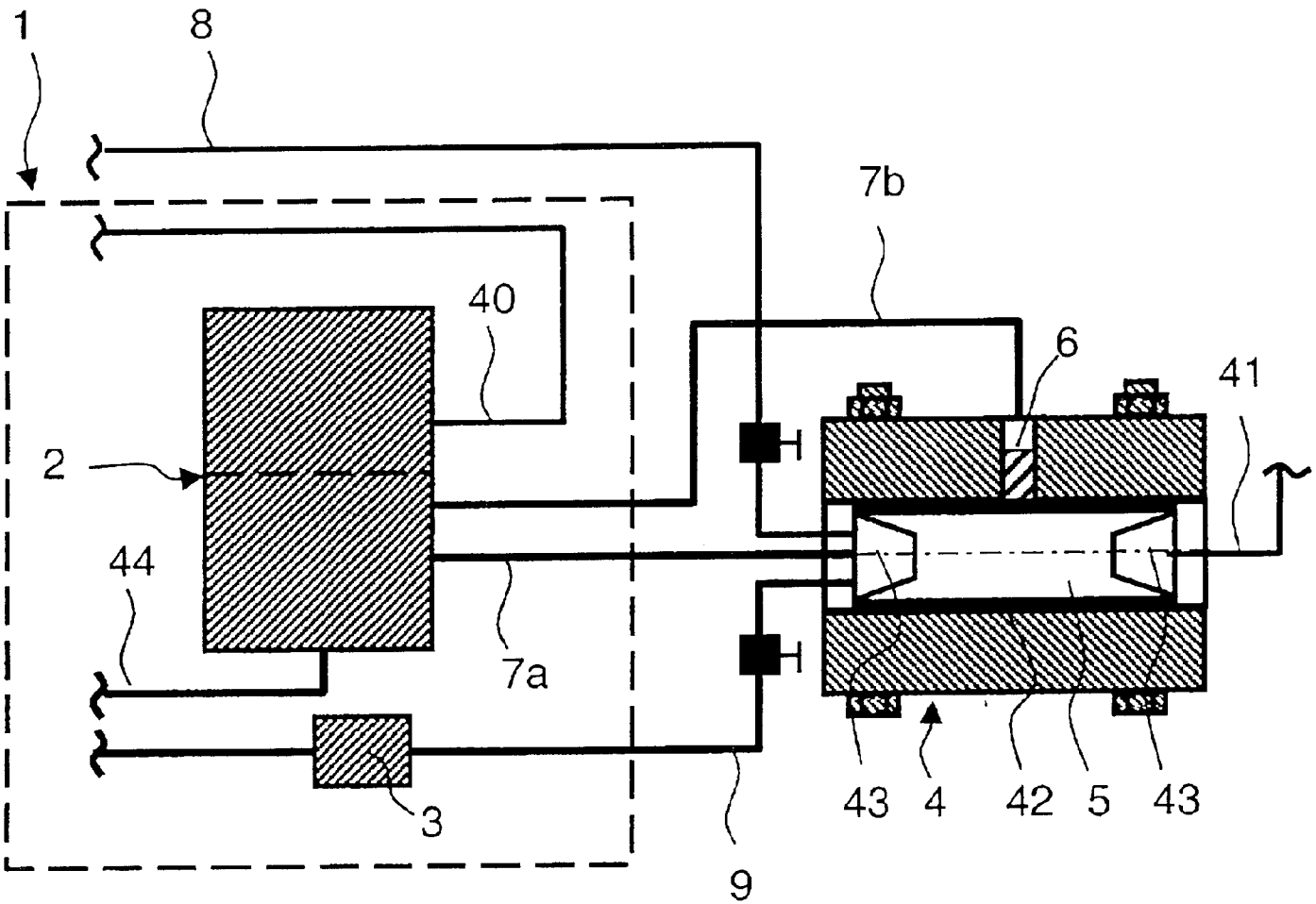
FIG. 1: schematic representation of a high internal pressure forming device according to the invention with pressure generating unit.

The HIPF device according to FIG. 1 contains a forming tool 4 with a cavity which accommodates a hollow section 42 with a hollow interior 5, whereby in order to achieve high internal pressure in the section interior 5, the end openings of the section are sealed off by stems 43. The HIPF device also contains pressure generating equipment 1 which comprises a pressure generating unit 2 made up of one or more high pressure piston pumps working in parallel and a pre-fill pump 3. The pre-fill pump 3 fills the section interior 5 via pressure pipe 9 with a working medium by and at the same time creates a base pressure there, while during the filling phase the section interior 5 is evacuated.

The pressure generating unit 2 contains a suction pipeline 44 through which the working medium is fed to the high pressure region via a suction port. Further, on the primary side, the pressure generating unit 2 contains an air drive pipeline 40 via which pneumatic power in the form of air is supplied at a pressure e.g. of 1–10 bar. A compressor (not shown here) may be installed prior to the air drive pipeline 40. The pressure supply line 7*a* is connected to the high pressure side of the pressure generating unit 2 via a pressure port. After a base pressure has been established by the pre-fill pump, the final pressure is built up by means of the pressure generating unit 2 via pressure supply line 7*a*, 41 and the forming process started. After the forming process, the working medium is driven out by means of compressed air which is introduced via pipeline 8 to the interior 5 of the section. The removal of the working medium from the section interior may take place by other means.

The forming tool 4 may also contain a hole-forming device 6 which contains a stem in an opening in the wall of the forming tool 4. The movement of the stem or its position is controlled by pressure regulation via pipeline 7*b*. The regulation of the pressure takes place via a high pressure piston pump in the pressure generating unit 2. The high pressure piston pump for controlling the movement of the stem may in some cases be a separate device which is uncoupled from the high internal pressure generating equipment.

Figure 2A:
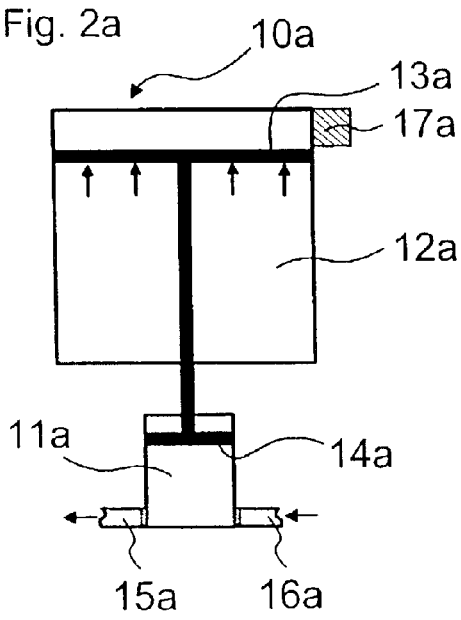
FIGS. 2*a,b*: function diagram of a single-acting high pressure piston pump with single stage air drive.

The high pressure piston pump 10*a,b* of a first version according to FIGS. 2*a,b* is a single stroke piston pump with single stage pneumatic drive. Compressed air is introduced into a pneumatic drive chamber 12*a,b* via air supply port 17*a,b*, whereby a pneumatic drive piston 13*a,b* is powered by compressed air acting on it. The pneumatic drive piston 13*a,b* is coupled to a high pressure piston 14*a,b* in a high pressure chamber 11*a,b*, whereby the high pressure piston 14*a,b* exhibits a smaller power transfer area than piston 13*a,b*, thus effecting an increase in pressure due to the conversion ratio. The high pressure chamber 11*a,b* contains a suction inlet 16*a,b* with an inlet valve and a pressure outlet 15*a,b* with an outlet valve. Depending on the phase of stroke of the oscillating pressure converter (pneumatic drive piston and high pressure piston) a fluid medium is sucked—by drawing back the high pressure piston creating a negative pressure—through a supply line from a reservoir via the inlet valve into the piston chamber of the high pressure chamber 11*a,b* and by advancing the high pressure piston 14*a,b* on creating a primary pressure p1 on the pneumatic drive piston 13*a,b*, and a secondary pressure p2 on the high pressure piston 14*a,b*, is pressed through the outlet valve into the pressure supply line and the section interior in order to create a high internal pressure there.

Figure 3A:
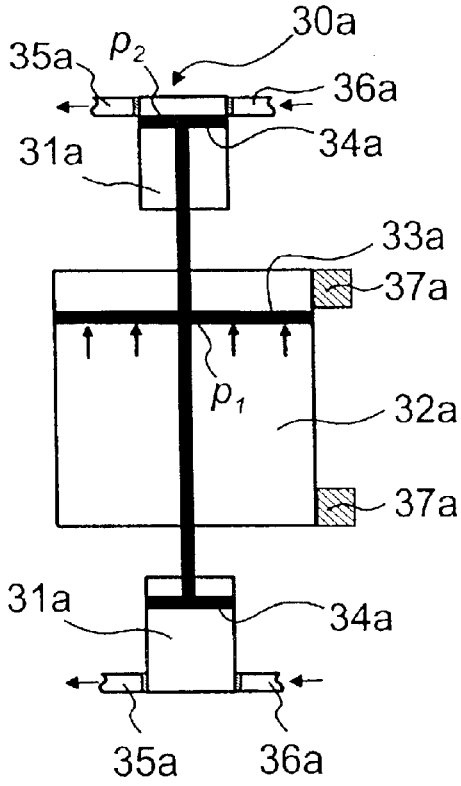
FIGS. 3*a,b*: function diagram of a double-acting high pressure piston pump with single stage air drive.
Figure 3B:
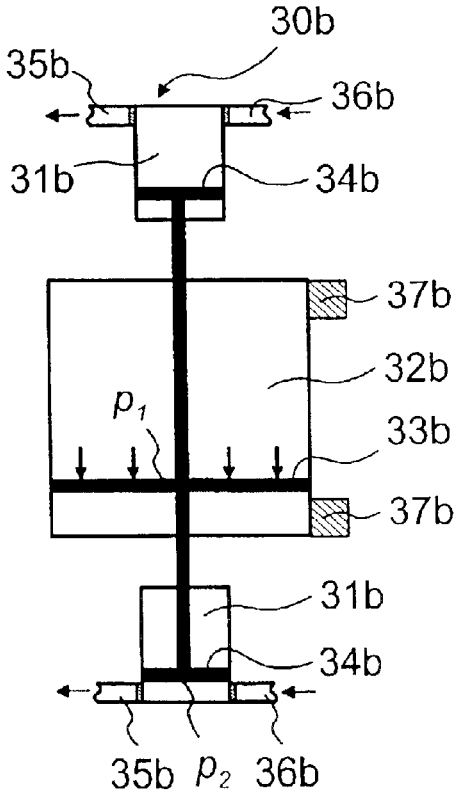

The high pressure piston pump 30*a,b* in a second version according to FIGS. 3*a,b* is a double stroke high pressure piston pump with single stage pneumatic drive. Alternating according to the phase of stroke, compressed air is supplied—via air supply ports 37*a,b* at both ends of the air drive chambers 32*a,b*—to an air drive chamber 32*a,b*, whereby a pneumatic drive piston 33*a,b* is power driven by compressed air acting on it alternately on both sides. The pneumatic drive piston 33*a,b* is coupled on each side to a high pressure piston 34*a,b* featuring a pair of high pressure chambers 31*a,b*, whereby both high pressure pistons 34*a,b* exhibit a smaller power transfer area than the pneumatic drive pistons 33*a,b*, thus effecting an increase in pressure due to the conversion ratio.

Both high pressure chambers 31*a,b* contain a suction inlet 36*a,b* with an inlet valve and a pressure outlet 35*a,b* with an outlet valve. Depending on the phase of stroke of the oscillating pressure converter (pneumatic drive piston and high pressure piston) a fluid medium is sucked—by drawing back the high pressure piston creating a negative pressure—through a supply line from a reservoir via the inlet valve into the piston chamber of the high pressure chamber 31*a,b* and—by advancing the high pressure piston 34*a,b* on creating a primary pressure $p_1$ on the pneumatic drive piston 33*a,b* and a secondary pressure $p_2$ on the high pressure piston 34*a,b*—is pressed through the outlet valve into the pressure supply line. Thereby, both high pressure chambers 31*a,b* are working in an alternating manner.

Figure 2B:
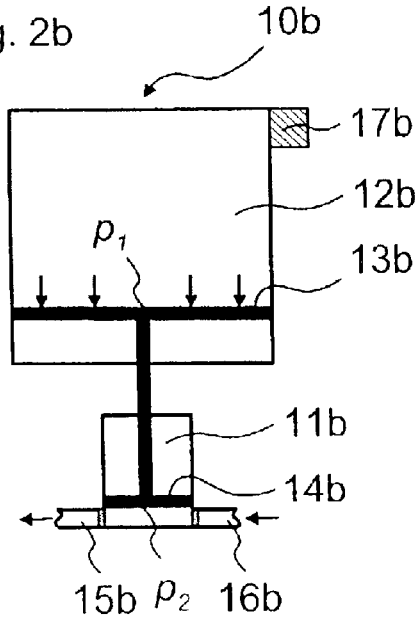
Figure 4A:
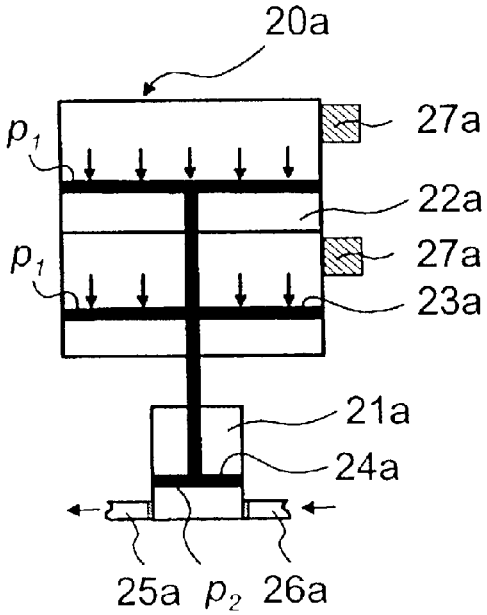
FIGS. 4*a,b*: function diagram of a single-acting high pressure piston pump with multi-stage air drive.
Figure 4B:
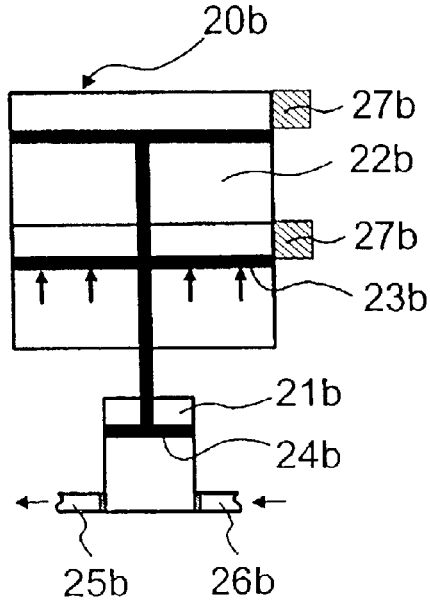

The high pressure piston pump 20*a,b* in a third version according to FIGS. 4*a,b* is a single stroke high pressure piston pump with two stage pneumatic drive. Compressed air is supplied via two air supply ports 27*a,b* in compartments of air drive chambers 22*a,b* each of which accommodates a pneumatic drive piston 23*a,b*, whereby both pneumatic drive pistons 23*a,b* are power driven simultaneously by compressed air. Both pneumatic drive pistons 23*a,b* are coupled to each other and jointly to a high pressure piston 24*a* in a high pressure chamber 21*a,b*, whereby the high pressure piston 24*a,b* exhibits a smaller power transfer area than the pneumatic drive pistons 23*a,b*, thus effecting an increase in pressure due to the conversion ratio. The high pressure chamber 21*a,b* contains a suction inlet 26*a,b* with an inlet valve and a pressure outlet 25*a,b* with an outlet valve. Depending on the phase of stroke of the oscillating pressure converter (pneumatic drive piston and high pressure piston) a fluid medium is sucked—by drawing back the high pressure piston creating a negative pressure—through a supply line from a reservoir via the inlet valve into the piston chamber of the high pressure chamber 21*a,b* and—by advancing the high pressure piston 24*a,b* on creating a primary pressure $P_1$ on the pneumatic drive piston 23*a,b* and a secondary pressure $p_2$ on the high pressure piston 24*a,b*—is pressed through the outlet valve into the pressure supply line. By employing two coupled pneumatic drive pistons the same final pressure can be achieved with half the air drive pressure required for a single stroke pump with a pneumatic drive piston according to FIG. 2. By adapting this example it is also possible to have three or more pneumatic drive pistons. Further, multi-stage pneumatic drive can be incorporated in two stroke pumps.

What is claimed is:

1. A device for forming a workpiece exhibiting at least one hollow space in its interior by means of high internal pressure created by a working medium capable of flow in the sealed hollow interior of the workpiece, said device comprising: a forming tool with a cavity configured to accommodate the workpiece; and pressure generating means for generating high internal pressure in the workpiece, the pressure generating means including a displacement pump with a pressure converter comprising a longitudinally coupled displacement body with different sized working surface areas $A_1$, $A_2$, and a high pressure chamber facing a smaller of the working surface areas $A_2$, the high pressure chamber having a suction side coupled to a suction port provided with an inlet armature and a pressure side coupled to a pressure port provided with an outlet armature, the displacement body being operative with a stroke frequency f, whereby a pressure $p_1$ created on a primary side can be converted into a higher secondary pressure $p_2$ by strokes of the pressure converter until an end pressure is reached on a secondary side, whereby a relationship:

$$p_2/p_1=A_1/A_2$$

defines the increase in pressure.

2. A device for forming a workpiece exhibiting at least one hollow space in its interior by means of a high internal pressure created by a working medium capable of flow in the sealed hollow interior of the workpiece, said device comprising: a forming tool with a wall and a cavity configured to accommodate the workpiece, the forming tool including means for producing recesses in the workpiece during the high internal pressure forming process, the recess producing means comprising a stem fitting in a space in the wall of the forming tool, whereby the recesses are created by withdrawing the stem from the workpiece by virtue of internal pressure; and pressure generating means for producing pressure to control stem movement by counter pressure on the stem, the pressure generating means including a displacement pump with a pressure converter comprising a longitudinally coupled displacement body with different sized working surface areas $A_1$, $A_2$, and a high pressure chamber facing a smaller of the working surface areas $A_2$, the high pressure chamber having a suction side coupled to a suction port provided with an inlet armature and a pressure side coupled to a pressure port provided with an outlet armature, the displacement body being operative with a stroke frequency f, whereby a pressure $p_1$ created on a primary side can be converted into a higher secondary pressure $p_2$ by strokes of the pressure converter until an end pressure is reached on a secondary side, whereby a relationship:

$$p_2/p_1=A_1/A_2$$

defines the increase in pressure.

3. A device according to claim 2, wherein the pressure generating means is operatively configured to generate the high internal pressure in the workpiece.

4. A device according to claim 2, wherein the recesses are holes.

5. A device according to claim 1, wherein the pressure generating means includes a high pressure piston pump which is powered on the primary side by compressed air.

6. A device according to claim 2, wherein the pressure generating means includes a high pressure piston pump which is powered on the primary side by compressed air.

7. A device according to claim 1, wherein the pressure generating means includes a high pressure piston pump with one of a single stage and a multi-stage piston drive on the primary side.

8. A device according to claim 2, wherein the pressure generating means includes a high pressure piston pump with one of a single stage and a multi-stage piston drive on the primary side.

9. A device according to claim 1, wherein the pressure generating means includes one of a single and a double stroke high pressure piston pump.

10. A device according to claim 2, wherein the pressure generating means includes one of a single and a double stroke high pressure piston pump.

11. A device according to claim 1, wherein the pressure generating means includes a plurality of high pressure piston pumps acting in parallel.

12. A device according to claim 2, wherein the pressure generating means includes a plurality of high pressure piston pumps acting in parallel.

13. A device according to claim 11, and further comprising a stroke frequency transformer operatively arranged to control the high pressure piston pumps so as to achieve a constant as possible flow of working medium.

14. A device according to claim 12, and further comprising a stroke frequency transformer operatively arranged to control the high pressure piston pumps so as to achieve a constant as possible flow of working medium.

15. A device according to claim 1, wherein the pressure generating means includes a pre-fill pump for filling the hollow interior of the workpiece with the working medium and for creating a base pressure.

16. A device according to claim 2, wherein the pressure generating means includes a pre-fill pump for filling the hollow interior of the workpiece with the working medium and for creating a base pressure.

17. A device according to claim 1, and further comprising a displacement pump operatively arranged to create forces for closing and holding the forming tool closed during the forming process.

18. A device according to claim 2, and further comprising a displacement pump operatively arranged to create forces for closing and holding the forming tool closed during the forming process.

19. A device according to claim 17, wherein the displacement pump is a high pressure piston pump.

20. A device according to claim 18, wherein the displacement pump is a high pressure piston pump.

21. A device according to claim 2, and further comprising a displacement pump operatively arranged to create closing and holding forces on the sealing stems which seal off the hollow space inside the workpiece.

22. A device according to claim 21, wherein the displacement pump is a high pressure piston pump.

23. A process for forming a workpiece exhibiting at least one internal hollow space by means of high internal pressure created by a medium capable of flow, comprising the steps of: sealing the hollow space inside the workpiece; supplying the medium to the sealed hollow space; and generating the high internal pressure in the hollow by a displacement pump to form the workpiece, the displacement pump including a pressure converter comprising a longitudinally coupled displacement body with different sized working surface areas $A_1$, $A_2$, and a high pressure chamber facing a smaller of the working surface areas $A_2$, the high pressure chamber having a suction side coupled to a suction port provided with an inlet armature and a pressure side coupled to a pressure port provided with an outlet armature, the displacement body being operative with a stroke frequency f, whereby a pressure $p_1$ created on a primary side can be converted into a higher secondary pressure $p_2$ by strokes of the pressure converter until an end pressure is reached on a secondary side, whereby a relationship:

$$p_2/p_1 = A_1/A_2$$

defines the increase in pressure.

* * * * *